US006192531B1

(12) United States Patent
Fritz et al.

(10) Patent No.: US 6,192,531 B1
(45) Date of Patent: Feb. 27, 2001

(54) TUB OVERFLOW WASTE ASSEMBLY

(75) Inventors: Kurt Fritz, Carson City, NV (US); Jerry P. Mitchell, Oak Grove, MO (US)

(73) Assignee: LSP Products Group, Inc., Carson City, NV (US)

( * ) Notice: Subject to any disclaimer, the term of this patent is extended or adjusted under 35 U.S.C. 154(b) by 0 days.

(21) Appl. No.: 09/452,597

(22) Filed: Dec. 1, 1999

(51) Int. Cl.[7] ..... E03C 1/12

(52) U.S. Cl. ..... 4/679; 4/680; 4/694; 138/90; 73/49.8; 285/46; 285/206

(58) Field of Search ..... 4/417, 420, 541.6, 4/538, 584, 679–695; 137/797; 138/90; 73/49.1, 49.8; 285/46, 206, 208; 210/248, 294, 320

(56) References Cited

U.S. PATENT DOCUMENTS

| | | | |
|---|---|---|---|
| 1,010,469 | 12/1911 | Weaver . | |
| 1,781,719 | 11/1930 | Darling . | |
| 2,052,565 | 9/1936 | Groeniger . | |
| 2,223,365 | 12/1940 | Groeniger . | |
| 2,243,204 | 5/1941 | Groeniger . | |
| 4,006,498 | 2/1977 | Cushera . | |
| 4,763,510 | 8/1988 | Palmer . | |
| 5,025,509 * | 6/1991 | Holt et al. | 4/206 |
| 5,507,501 | 4/1996 | Palmer . | |
| 5,890,241 | 4/1999 | Ball . | |

* cited by examiner

*Primary Examiner*—Henry J. Recla
*Assistant Examiner*—Tuan Nguyen
(74) *Attorney, Agent, or Firm*—Monty L. Ross; Locke Liddell & Sapp LLP

(57) ABSTRACT

A tub waste overflow assembly is provided that is attachable to a tub wall by means of a threaded retaining body insertable through an overflow drain aperture in a tub wall to engage a cooperatively threaded pipe fitting on the opposite side of the tub wall. A chamfered washer is provided to cooperate with the retaining body and an annular sealing gasket to produce a fluid-tight seal on the interior surface of the tub wall and provide frictional engagement with a cover member spanning the drain aperture.

17 Claims, 4 Drawing Sheets

TUB OVERFLOW WASTE ASSEMBLY

BACKGROUND OF THE INVENTION

1. Field of the Invention

This invention relates to overflow waste assemblies for tubs such as bathtubs and spas, and more particularly, to an overflow waste assembly utilizing a screw-in retaining body in combination with a chamfered washer and an annular gasket to provide a reliable, water-tight seal at a variety of tub wall angles while maintaining a vertical waste drop. This invention also relates to an overflow waste assembly having a retaining body with a mold-in-place test plug.

2. Description of Related Art

The use of waste water overflow drains in tubs such as bathtubs and spas is well known. Such overflow drains are typically located at or near the maximum intended fill level of the tub and in proximity to plumbing connecting the main tub drain to a sewer line. Prior art fittings for tub waste overflows are disclosed, for example, in the following U.S. Pat. Nos. 1,010,469; 1,781,719; 2,052,565; 2,223,365; 2,243,204; and 5,890,241. Test plugs for hydraulic testing of plumbing systems are disclosed, for example, in U.S. Pat. Nos. 4,763,510; 5,507,501 and 5,890,241.

Tub waste overflows usually comprise some type of fitting that connects a portion of the fitting on the inside of the tub to a drain line disposed behind the tub wall. A cover plate having recesses that admit water but not foreign objects into the drain system is generally provided on the inside of the tub. Sealing gaskets are desirably utilized on both sides of the tub wall to prevent water from leaking around the fitting. Because tub wall angles can vary significantly, tub waste overflow assemblies are desirably adaptable to provide a water-tight connection when installed in tubs having different wall angles. Tub waste overflow assemblies should also be capable of being hydraulically tested following installation without having to break the tub seal.

SUMMARY OF THE INVENTION

A tub waste overflow assembly is disclosed that is attachable to a tub wall by means of a threaded retaining body insertable through an overflow drain aperture in a tub wall to engage a cooperatively threaded pipe fitting on the opposite side of the tub wall. A chamfered washer is provided to cooperate with the retaining body and an annular sealing gasket to produce a fluid-tight seal on the interior surface of the tub wall and frictionally engage a cover member spanning the overflow drain aperture. Optionally, a removable test plug is molded in place across the mouth of the retaining body to facilitate hydraulic testing following installation.

According to one preferred embodiment, the invention disclosed herein is a tub waste overflow assembly having a substantially cylindrical body with a threaded male end that is insertable through an aperture in a tub wall for engagement with a cooperatively threaded female end of a drain pipe elbow disposed behind the tub wall, a flange end opposite the threaded male end, a chamfered annular plastic washer disposed between the flange end of the cylindrical body and the interior tub wall, a first annular gasket underlying the plastic washer between the plastic washer and the interior tub wall, and a second annular gasket disposed between the female end of the drain pipe elbow and the exterior tub wall.

According to another embodiment of the invention, a tub overflow waste assembly is disclosed that is attachable to a tub through an aperture in the tub wall. The assembly comprises a retaining body having a threaded, substantially cylindrical member that is insertable through the aperture and rotatable to threadedly engage a threaded pipe fitting aligned with the aperture outwardly of the tub. A flange member is disposed adjacent to the cylindrical member interiorly of the tub wall and has an outside diameter greater than the diameter of the aperture. The flange member also has an inclined surface facing the tub wall, and a continuous axial bore through the threaded cylindrical member and the flange member. The tub overflow waste assembly also includes an annular polymeric washer having a bore coaxially aligned with the bore through the threaded cylindrical member, the bore of the annular washer having a diameter slightly greater than that of the threaded, substantially cylindrical member of the retaining body. The annular washer further comprises an interiorly facing, chamfered surface cooperatively alignable with the inclined surface of the flange member of the retaining body to create abutting contact therebetween upon full insertion of the threaded cylindrical member into the washer bore; The annular washer also has an annular gasket seating surface facing the tub wall around the aperture, an interior tub gasket cooperatively alignable with the annular gasket seating surface of the annular washer; and a cover member for the retaining body, the cover member being attachable to the annular washer by is frictional engagement.

According to another embodiment of the invention, a screw-in retaining body for a tub or spa overflow drain is provided that includes a selectively removable test plug that is molded in place across the mouth of the retaining body.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
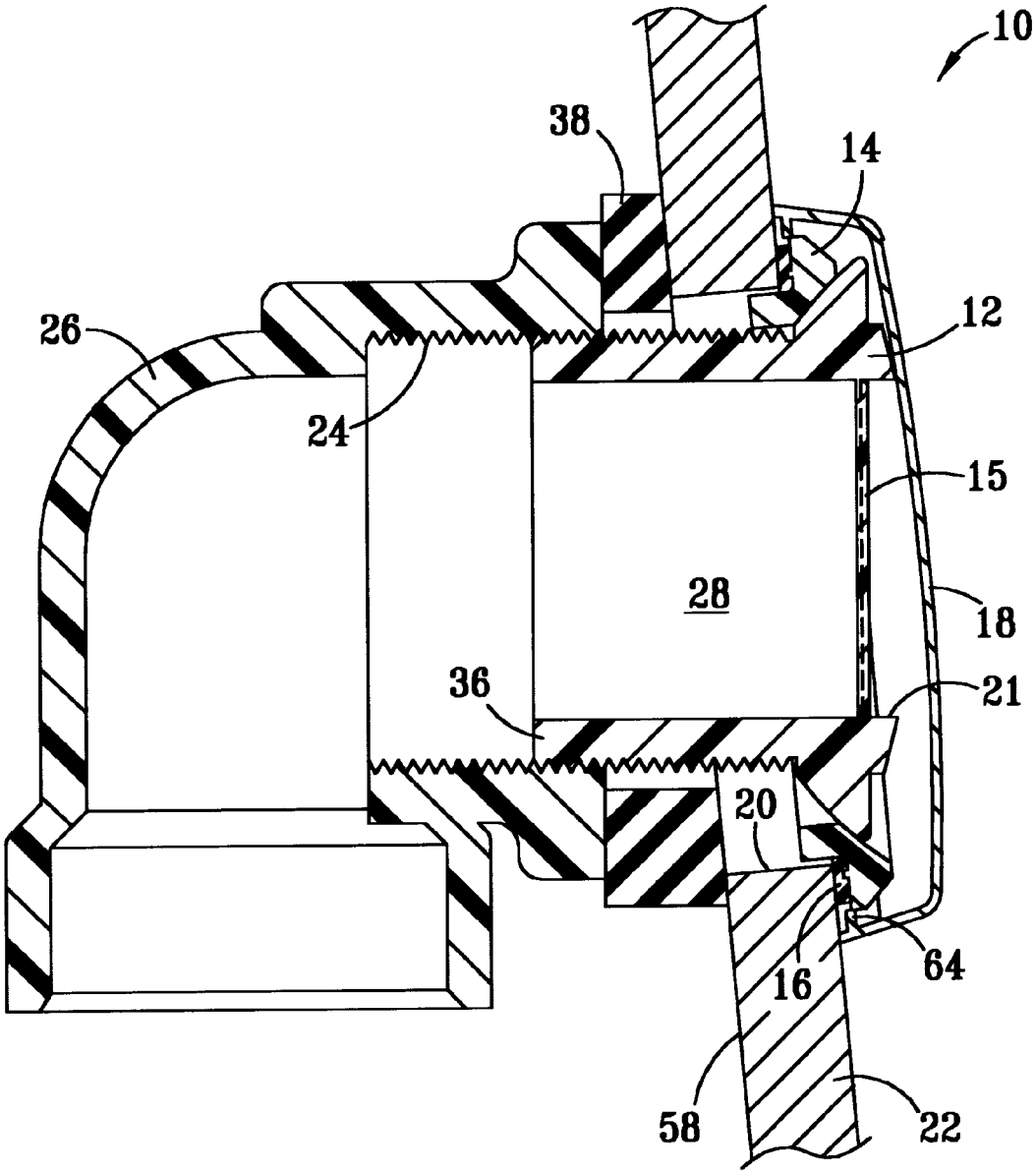
FIG. 1 is a simplified, cross-sectional elevation view of a preferred embodiment of the tub overflow waste assembly of the invention.
Figure 2:
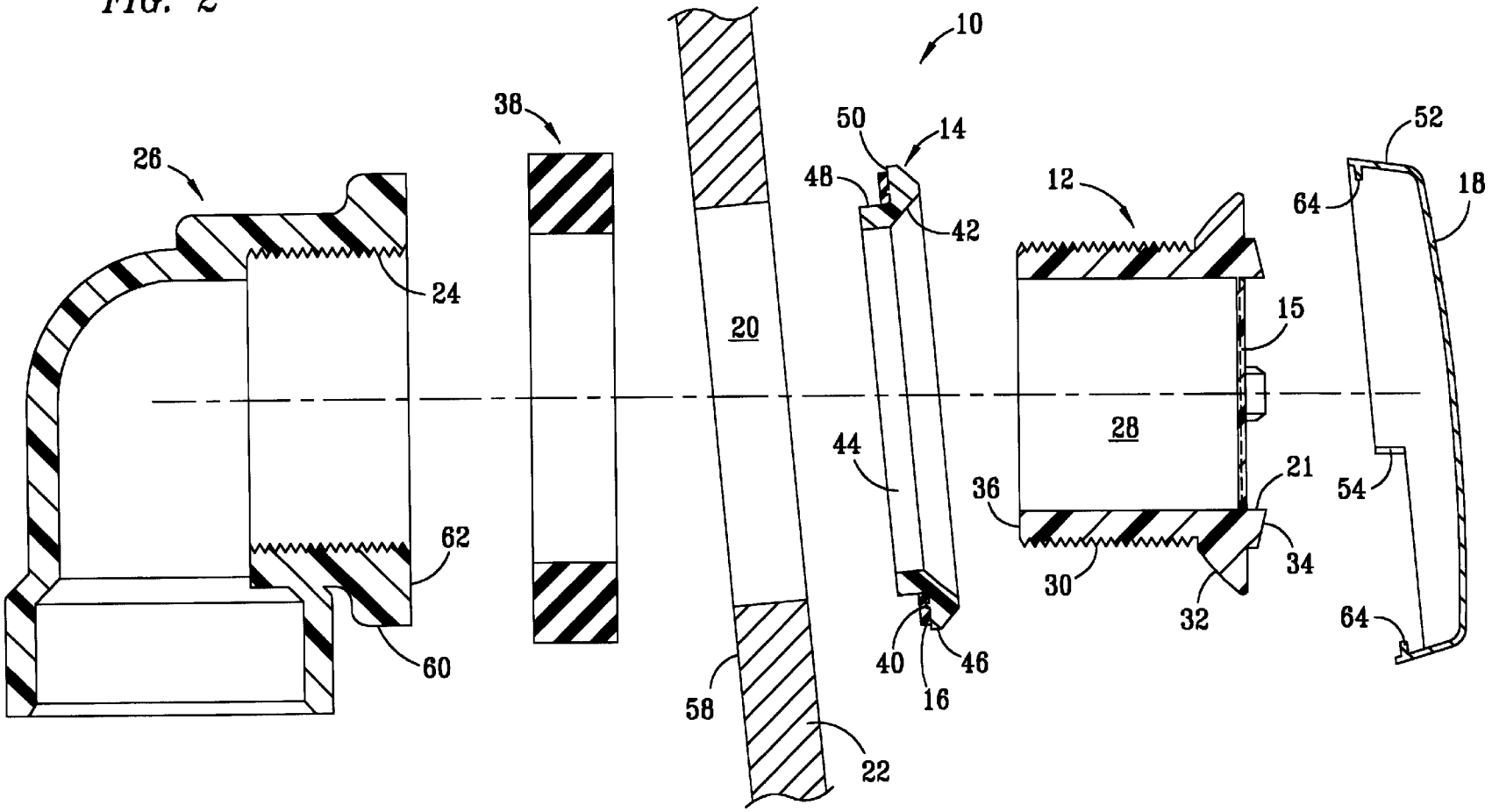
FIG. 2 is an exploded view of the tub overflow waste assembly of FIG. 1.
Figure 3:
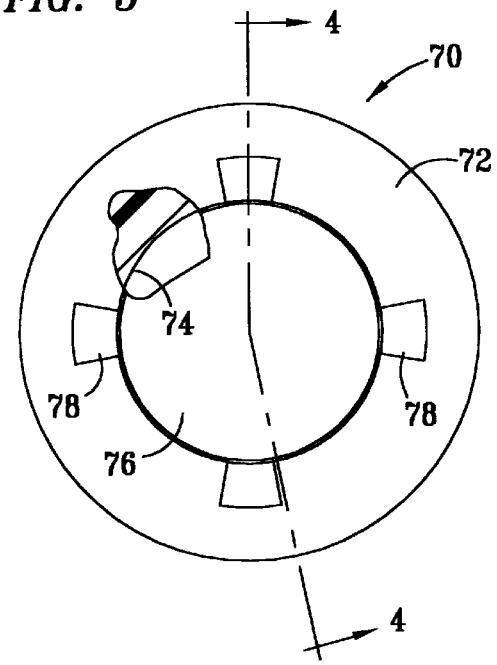
FIG. 3 is a front elevation view of a preferred embodiment of the threaded retaining body of the invention as viewed from the interior of the tub.
Figure 4:
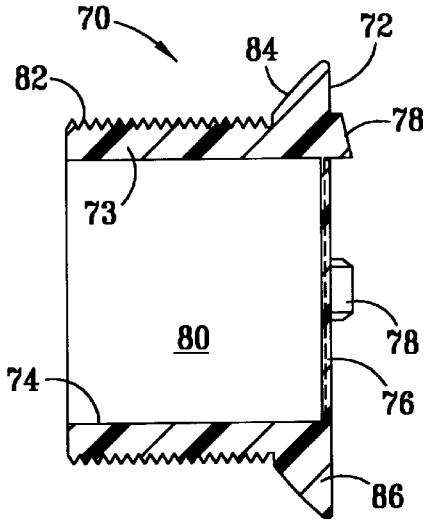
FIG. 4 is a cross-sectional side elevation view taken along line 4—4 of FIG. 3.
Figure 5:
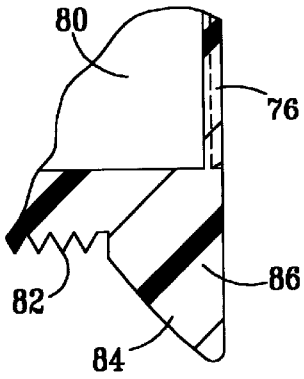
FIG. 5 is a detail view taken from FIG. 4.

Referring to FIGS. 1 and 2, tub overflow waste assembly 10 of the invention preferably comprises retaining body 12, chamfered washer 14, interior tub gasket 16 and cover 18. Retaining body 12 is preferably adapted for insertion through aperture 20 in tub wall 22 and for threaded engagement with internally threaded female end 24 of a pipe segment such as elbow 26 disposed behind tub wall 22.

Retaining body 12 preferably comprises a substantially cylindrical bore 28, a male threaded section 30, an inclined annular flange 32 and a plurality of circumferentially spaced, axially extending lugs 34 opposite male threaded end 36. Although retaining body 12 can be made of metal or a durable polymeric material, it is preferably made of a polymeric material such as acrylonitrile butadiene styrene terpolymer ("ABS"). According to a particularly preferred embodiment of the invention, a relatively thin, continuous test plug 15 is either molded in place or otherwise provided across the mouth 21 of retaining body to facilitate hydraulic testing.

During makeup of tub overflow waste assembly 10, end 36 of retaining body 12 is inserted through chamfered washer 14 and interior tub gasket 16, then through aperture 20 in tub wall 22, through exterior tub gasket 38, and into threaded engagement with female threads 24 of elbow 26. Lugs 34 on retaining body 12 are useful for rotating retaining body 12 relative to elbow 26 during tightening of assembly 10. As retaining body 12 is threaded into elbow 26, inclined annular flange surface 32 of retaining body 12 desirably contacts and abuts against correspondingly inclined, chamfered annular surface 42 of washer 14.

Chamfered washer 14 is preferably made of polypropylene or any other similarly useful, durable polymeric material and further comprises a substantially cylindrical collar section 44 adjacent to annular surface 42. The inside diameter of cylindrical collar section 44 is desirably slightly greater than the outside diameter of male threaded section 30 of retaining body 12 to permit threaded section 30 to extend through it in a closely fitting relationship whenever inclined annular surface 32 of retaining body 12 is fully seated against inclined annular surface 42 during tightening. Chamfered washer 14 preferably has a stepped outside wall defining a flange wall 46 having an outside diameter greater than the diameter of aperture 20 through tub wall 22, and a recessed cylinder wall 48 having a diameter slightly less than the diameter of aperture 20. Recessed cylinder wall 48 locates chamfered washer 14 in aperture 20. Annular flange shoulder 50 extending between sidewall sections 46, 48 is preferably sufficiently wide to overlap the interior surface of tub wall 22 around aperture 20 and provide sufficient surface area contacting interior tub gasket 16 to produce a fluid-tight seal relative to aperture 20 whenever retaining body 12 is tightened relative to elbow 26. Interior tub gasket 16 is preferably made of rubber, such as ethylene propylene diamine rubber (EPDM), or any other compressible material that is similarly useful as a gasket between retaining body 12 and the interior surface of tub wall 22.

Cover 18 can be made of metal or plastic, and desirably has a diameter and thickness adequate to cover retaining body 12, chamfered washer 14 and interior sealing gasket 16. A plurality of tabs 64 or other protrusions directed radially inward from the inside of sidewall 52 of cover 18 preferably provide frictional engagement between cover 18 and flange wall 46 or flange shoulder 50 of chamfered washer 14. Unlike the cover portions of most prior art tub waste overflow fixtures, cover 18 will preferably have a smooth, featureless surface facing the interior of the tub because no screws are required to hold cover 18 in place over retaining body 12. Circumferentially extending sidewall 52 of cover 18 is preferably slotted or recessed along its bottom or lower side edges, and the width of slot(s) 54 is sufficient to permit tub waste overflow to enter bore 28 of retaining body 12 behind cover 18 during use.

A fluid-tight seal between elbow 26 and exterior surface 58 of tub wall 22 around aperture 20 is desirably achieved using an exterior tub gasket 38. According to one particularly preferred embodiment of the invention, elbow 26 is a 90 degree plastic pipe elbow with one 1½ inch diameter, schedule 24 female slip fitting and one 1½ inch diameter threaded female fitting. Exterior tub gasket 38 is preferably a compressible, annular gasket, most preferably made of a foamed polymeric material. Exterior tub gasket 38 desirably has an outer diameter equal to or greater than the outer diameter of flange 60 of elbow 26 and a thickness sufficient to produce a fluid-tight seal around aperture 20 of tub wall 22 when retaining body 12 is tightened relative to elbow 26. Gasket 38 should produce a fluid-tight seal even when exterior surface 58 of tub wall 22 is inclined at an angle relative to the plane defined by end 62 of elbow 26. Satisfactory materials for use in making exterior tub gasket 38 include, for example, closed cell polyurethane, butyl rubber or EPDM rubber.

Figure 6:
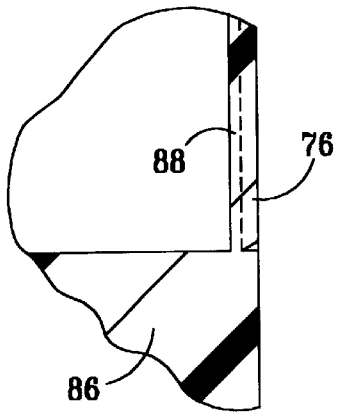
FIG. 6 is a detail view taken from FIG. 5.
Figure 7:
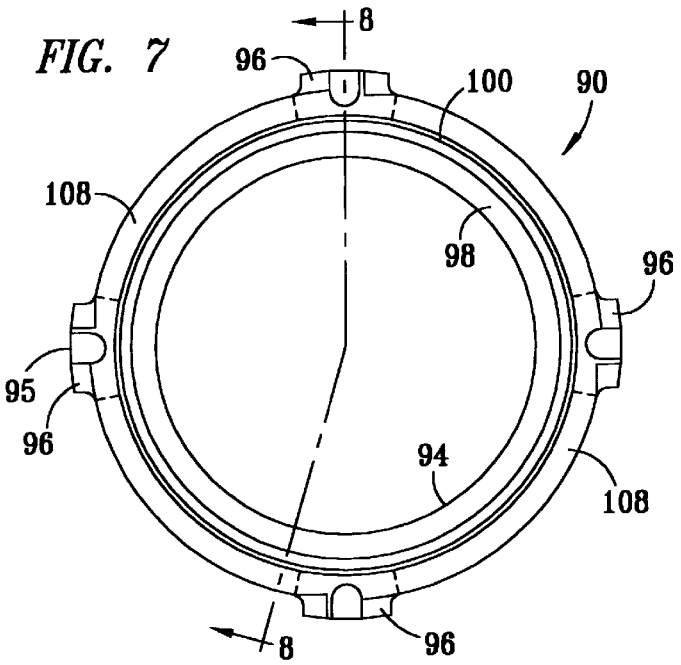
FIG. 7 is a front elevation view of a preferred embodiment of the plastic washer of the invention as viewed facing the interior of the tub from the aperture through the tub wall.

Referring to FIGS. 3–6, another preferred embodiment of a retaining body 70 suitable for use in tub overflow waste assembly of the invention is shown that comprises a substantially cylindrical sidewall section 73 having a centrally disposed bore 80 defined by sidewall 74. Annular flange 72 surrounds one end of retaining body 70 and is undercut by annular bevel 84 to facilitate engagement with plastic washer 90 as described below in relation to FIGS. 7–9 and 12. A plurality of circumferentially spaced lugs 78 extend forwardly of flange 72 to facilitate installation and removal of retaining body 70. Male threads 82 are desirably provided behind flange 72. Retaining body 12 is desirably molded from a suitable polymeric material and can be made with a removable test plug 76, preferably unitarily molded together with retaining body 70, that seals off the end of bore 80 that is more nearly adjacent to flange 72. Test plug 76 is beneficial for use in hydraulic testing of the installed tub overflow waste assembly without the necessity of loosening retaining body 70 and breaking either the interior or exterior tub seal. The thickness of test plug 76 is preferably adequate to resist rupture when exposed to the hydraulic pressures encountered during leak testing but susceptible to being removed following such testing. Referring to FIG. 6, a beveled recess 88 can be provided around the edges of test plug 76 to weaken the edges of the plug and facilitate its removal. Although not shown in FIGS. 3–6, it will be appreciated that a tab can also be provided on the forwardly facing surface of test plug 76 to facilitate removal subsequent to testing to reduce the likelihood that test plug 76 will fall into the drain pipe behind the tub.

Referring to FIGS. 7–12, another preferred chamfered washer 90 is disclosed that is similarly useful in place of washer 14, previously described in relation to FIGS. 1 and 2, in the tub overflow waste assembly of the invention. Washer 90 is an annular washer, preferably made of injection molded plastic, most preferably polypropylene, further comprising an annular chamfer 104 inclined at an angle that provides continuous, facing contact with undercut bevel 84 of retaining body 70 whenever the threaded end of retaining body 70 is inserted through washer 90. The narrower end of chamfer 104 is desirably contiguous with inside surface 94 of cylindrical collar portion 98. The length and outside diameter of collar portion 98 are desirably such that collar portion 98 will locate washer 90 in the tub aperture through which the tub overflow waste assembly of the invention is installed. The thickness of collar portion 98 is preferably sufficient to locate the washer relative to the aperture, with inside surface 94 fitting snugly against the threaded portion 82 of retaining body 70.

Figure 8:
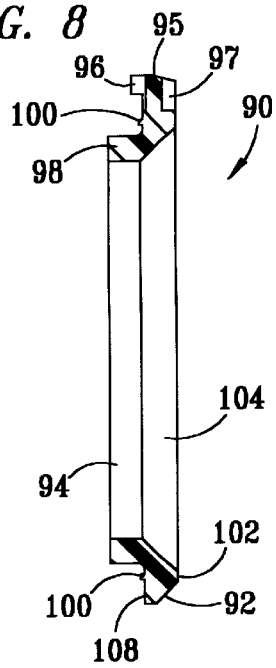
FIG. 8 is a cross-sectional side elevation view taken along line 8—8 of FIG. 7.
Figure 9:
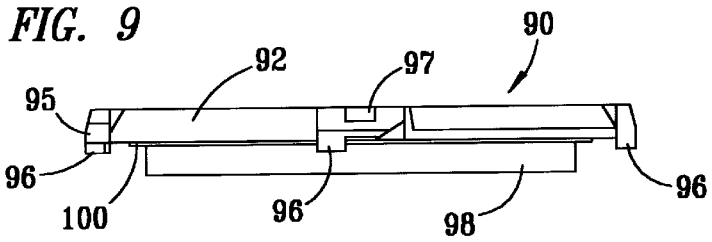
FIG. 9 is a top plan view of the plastic washer of FIG. 7.
Figure 10:
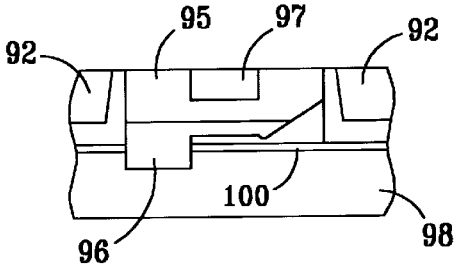
FIG. 10 is a detail view taken from FIG. 9.
Figure 11:
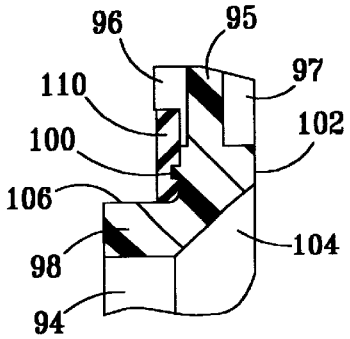
FIG. 11 is a detail view taken from FIG. 8.
Figure 12:
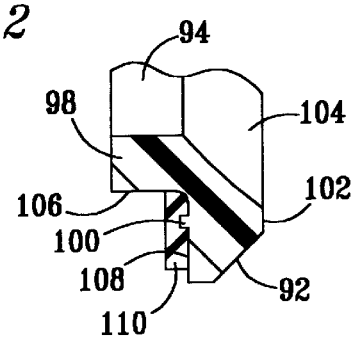
FIG. 12 is a detail view taken from FIG. 8.

Referring more particularly to FIGS. 10–12, which show details taken from FIGS. 8 and 9, washer 90 preferably further comprises a plurality of circumferentially spaced lugs 95, each having a stud 96 facing toward the tub wall and an oppositely facing recess 97. In FIGS. 11 and 12, the details of washer 90 are shown in combination with interior tub gasket 110 for clarity of illustration. Lugs 95 extend radially outward beyond the periphery of inclined surface 92, which is desirably separated from chamfer 104 by surface 102 to facilitate molding. Annular bead 100 is provided on annular gasket seating surface 108 of washer 90 and cooperates with studs 96 and outside wall 106 of collar portion 98 in locating interior tub gasket 110 relative to the aperture through the tub wall. Studs 96 also define the minimal spacing between annular gasket seating surface 108 of washer 90 and the underlying tub surface to reduce the likelihood of damaging interior tub gasket 110 and bead 100 when retaining body 70 as described above is screwed into a drain pipe fitting disposed behind the tub wall. Interior tub gasket 110 is preferably made of rubber, such as ethylene propylene diamine rubber (EPDM), or any other compressible material that is similarly useful as a gasket between retaining body 70 and the interiorly facing surface of the tub wall.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A tub overflow waste assembly attachable to a tub wall through an aperture in the tub wall, the assembly comprising:

a retaining body having a threaded, substantially cylindrical member insertable through the aperture and adapted to be reversibly engageable with a cooperatively threaded pipe fitting aligned with the aperture outwardly of the tub, a flange member disposed adjacent to the cylindrical member interiorly of the tub wall, the flange member having an outside diameter greater than the aperture and an inclined surface facing the tub wall, and a continuous axial bore through the threaded cylindrical member and the flange member;

an annular polymeric washer having a second bore coaxially aligned with the bore through the threaded cylindrical member, the second bore having a diameter slightly greater than that of the threaded, substantially cylindrical member of the retaining body, the annular washer further comprising an interiorly facing, chamfered surface cooperatively alignable with the inclined surface of the flange member of the retaining body to create abutting contact therebetween upon full insertion of the threaded cylindrical member into the washer bore, the annular washer also having an annular gasket seating surface facing the tub wall around the aperture;

an interior tub gasket cooperatively alignable with the annular gasket seating surface of the annular washer; and a cover member having a fluid path that admits overflow waste into the bore of the retaining body.

2. The tub overflow waste assembly of claim 1 wherein the retaining body further comprises a removable test plug.

3. The tub overflow waste assembly of claim 1 wherein the retaining body is made of a moldable polymeric material.

4. The tub overflow waste assembly of claim 3 comprising a removable test plug that is unitarily molded as part of the retaining body.

5. The tub overflow waste assembly of claim 1 wherein the annular washer comprises a cylindrical collar member having an inside wall defining the second bore and an outside wall that is locatable within the aperture.

6. The tub overflow waste assembly of claim 1 wherein the gasket seating surface of the annular washer further comprises an annular bead.

7. The tub overflow waste assembly of claim 1 wherein the annular washer further comprises a plurality of circumferentially spaced studs facing the tub wall and disposed radially outward of the annular gasket seating surface.

8. The tub overflow waste assembly of claim 1 wherein the retaining body further comprises a plurality of circumferentially spaced lugs extending from the flange member opposite the threaded cylindrical member.

9. The tub overflow waste assembly of claim 1 wherein the retaining body is made of acrylonitrile butadiene styrene terpolymer.

10. The tub overflow waste assembly of claim 1 wherein the polymeric washer is made of polypropylene.

11. The tub overflow waste assembly of claim 1 wherein the interior tub gasket is made of a compressible polymeric material.

12. The tub overflow waste assembly of claim 1 wherein the cover member is attachable to the annular washer without screws.

13. The tub overflow waste assembly of claim 1, further comprising an exterior tub gasket made of a compressible polymeric material.

14. The tub overflow waste assembly of claim 1, further comprising a pipe fitting adapted for threaded engagement with the threaded cylindrical member of the retaining body exteriorly of the tub wall.

15. The tub overflow waste assembly of claim 14 wherein the pipe fitting is an elbow.

16. The tub overflow waste assembly of claim 14 wherein the pipe fitting has female threads.

17. The tub overflow waste assembly of claim 1 wherein the threaded cylindrical member of the retaining body has male threads.

* * * * *